US011746568B2

(12) United States Patent
Tse et al.

(10) Patent No.: US 11,746,568 B2
(45) **Date of Patent: *Sep. 5, 2023**

(54) CLAMP LOCK FOR PORTABLE ELECTRONIC DEVICE

(71) Applicant: ACCO Brands Corporation, Lake Zurich, IL (US)

(72) Inventors: Wilson S. Tse, Burnaby (CA); James Kao, Fremont, CA (US); Mike D. Otsuka, Sunnyvale, CA (US); Alex J. Klinkman, Campbell, CA (US); William De Meulenaere, Newark, CA (US)

(73) Assignee: ACCO Brands Corporation, Lake Zurich, IL (US)

( * ) Notice: Subject to any disclaimer, the term of this patent is extended or adjusted under 35 U.S.C. 154(b) by 137 days.

This patent is subject to a terminal disclaimer.

(21) Appl. No.: 17/233,684

(22) Filed: Apr. 19, 2021

(65) Prior Publication Data

US 2021/0238894 A1 Aug. 5, 2021

Related U.S. Application Data

(63) Continuation of application No. 16/001,184, filed on Jun. 6, 2018, now Pat. No. 10,982,468.

(Continued)

(51) Int. Cl.
*E05B 73/00* (2006.01)

(52) U.S. Cl.
CPC ..... *E05B 73/0082* (2013.01); *E05B 73/0005* (2013.01)

(58) Field of Classification Search
CPC .. E05B 73/00; E05B 73/0082; E05B 73/0005; Y10T 70/40; Y10T 70/409; Y10T 70/411; Y10T 70/50; Y10T 70/5009

(Continued)

(56) References Cited

U.S. PATENT DOCUMENTS 3,875,771 A 4/1975 Reisner
3,895,768 A 7/1975 Scheck (Continued)

FOREIGN PATENT DOCUMENTS

CN 101131058 A 2/2008
EP 266294 A1 5/1988

(Continued)

OTHER PUBLICATIONS

Taiwanese Patent Office Action for Application No. 107119344 dated Feb. 26, 2021 (8 pages including statement of relevance).

(Continued)

*Primary Examiner* — Suzanne L Barrett
(74) *Attorney, Agent, or Firm* — Michael Best & Friedrich LLP

(57) ABSTRACT

A clamp lock includes a body, a lock mechanism coupled to the body, and a clamping member supported by the body and operatively coupled to the lock mechanism. The clamping member and body cooperatively define a slot. The clamping member is movable relative to the body by actuating the lock mechanism from a first position, in which the clamping member is configured to engage the part of the portable electronic device, to a second position, in which the clamping member is configured to disengage the portable electronic device. The clamp lock includes a spring configured to bias the clamping member toward the second position. The slot includes an opening at an outer periphery of the body and an inner channel located inward of the opening. The opening has a first height and the inner channel has a second height that is larger than the first height.

20 Claims, 13 Drawing Sheets

Related U.S. Application Data

(60) Provisional application No. 62/515,806, filed on Jun. 6, 2017, provisional application No. 62/515,808, filed on Jun. 6, 2017.

(58) Field of Classification Search
USPC ..... 70/14, 18, 19, 57, 58; 248/551–553
See application file for complete search history.

(56) References Cited

U.S. PATENT DOCUMENTS

| | | | |
|---|---|---|---|
| 4,912,949 | A | 4/1990 | Bowers |
| 5,052,199 | A | 10/1991 | Derman |
| 5,577,855 | A | 11/1996 | Leyden et al. |
| 5,595,074 | A | 1/1997 | Munro |
| 5,836,183 | A | 11/1998 | Derman |
| 6,308,540 | B1 | 10/2001 | Lee |
| 6,308,928 | B1 | 10/2001 | Galant |
| 6,443,417 | B2 | 9/2002 | Galant |
| 6,598,433 | B1 | 7/2003 | Malvasio |
| 7,299,668 | B1 | 11/2007 | Lu |
| 7,315,443 | B2 | 1/2008 | Allen |
| 7,324,333 | B2 | 1/2008 | Allen |
| 7,443,665 | B2 | 10/2008 | Allen |
| 7,449,270 | B2 | 11/2008 | Kim et al. |
| 7,499,269 | B2 | 3/2009 | Allen |
| 7,611,119 | B2 | 11/2009 | Rossini |
| 7,724,520 | B2 | 5/2010 | Allen |
| 8,223,488 | B2 | 7/2012 | Peter |
| 8,402,798 | B2 | 3/2013 | Brojanac et al. |
| 8,413,943 | B1 | 4/2013 | Li |
| 8,701,452 | B2 | 4/2014 | Foster et al. |
| 8,756,771 | B1 | 6/2014 | Moreau et al. |
| 8,833,117 | B2 | 9/2014 | Yang |
| 8,844,329 | B2 | 9/2014 | Anderson |
| 9,775,262 | B1 | 9/2017 | Hsieh et al. |
| 10,982,468 | B2 * | 4/2021 | Tse ..... E05B 73/0082 |
| 2005/0077448 | A1 | 4/2005 | Rossini |
| 2009/0235699 | A1 | 9/2009 | Hsiao et al. |
| 2011/0061427 | A1 | 3/2011 | Mahaffey et al. |
| 2013/0067967 | A1 | 3/2013 | Olear et al. |
| 2014/0071619 | A1 | 3/2014 | Yang |
| 2014/0238091 | A1 | 8/2014 | Allen |
| 2016/0090755 | A1 | 3/2016 | Lee |

FOREIGN PATENT DOCUMENTS

| | | | |
|---|---|---|---|
| TW | 201408854 | A1 | 3/2014 |
| TW | 489195 | U | 11/2014 |
| WO | 9007046 | A1 | 6/1990 |
| WO | 9624736 | A1 | 8/1996 |
| WO | 9839541 | A1 | 9/1998 |
| WO | 9055458 | A1 | 9/2000 |

OTHER PUBLICATIONS

Taiwanese Patent Office Action for Application No. 107119344 dated Jun. 1, 2020 (5 pages including statement of Yelevance).

European Patent Office Extended Search Report for Application No. 18813964.6 dated Mar. 11, 2020 (8 pages).

Taiwanese Patent Office Action and Search Report for Application No. 107119344 dated Oct. 25, 2019 (16 pages ncluding statement of relevance).

International Search Report and Written Opinion for Application No. PCT/US2018/036221 dated Sep. 28, 2018 (12 pages).

* cited by examiner

CLAMP LOCK FOR PORTABLE ELECTRONIC DEVICE

CROSS REFERENCE TO RELATED APPLICATIONS

This application is a continuation of U.S. patent application Ser. No. 16/001,184, filed Jun. 6, 2018, which claims priority to U.S. Provisional Patent App. No. 62/515,806, filed Jun. 6, 2017, and U.S. Provisional Patent App. No. 62/515,808, filed Jun. 6, 2017, the entire contents of which are herein incorporated by reference.

FIELD OF THE INVENTION

The present invention relates to physical locks for portable electronic devices.

SUMMARY

In one embodiment, the invention provides a clamp lock for securing a portable electronic device includes a body having a slot configured to receive part of the portable electronic device, a lock mechanism supported by the body, and a clamping member supported by the body and operatively coupled to the lock mechanism. The clamping member is movable relative to the body by actuating the lock mechanism between a first position, in which the clamping member extends into the slot and is configured to engage the part of the portable electronic device, and a second position, in which the clamping member is configured to disengage the portable electronic device. The clamp lock further comprises a security member coupled to the body and configured to be coupled to an immovable object.

In some configurations, the slot includes an opening at an outer periphery of the body and an inner channel located inward of the opening, wherein the opening has a first height, and wherein the inner channel has a second height that is larger than the first height.

In some configurations, a spring is coupled to the body and configured to bias the clamping member toward the second position.

In some configurations, the lock mechanism includes a lock cylinder configured to be actuated by a key, and an actuation cam coupled to the lock cylinder for rotation with the lock cylinder.

In some configurations, the actuation cam is operatively coupled to the clamping member, the clamping member being movable relative to the body by actuating the actuation cam.

In some configurations, the clamping member includes a generally planar surface, wherein the generally planar surface is configured to engage the part of the portable electronic device.

In some configurations, the clamping member moves linearly between the first position and the second position.

In some configurations, the security member includes a ferrule secured to the body, and a flexible cable secured to the ferrule.

In another embodiment, a portable electronic device is secured with a clamp lock. The clamp lock includes a body, a lock mechanism supported by the body, a clamping member supported by the body, and a security member coupled to the body. A method of securing the portable electronic device with the clamp lock includes receiving a part of the portable electronic device within a slot of the body of a clamp lock. The lock mechanism is actuated to move the clamping member from a disengaged position in which the clamping member does not engage the portable electronic device to an engaged position in which the clamping member engages the part of the portable electronic device. The security member is coupled to an immovable object.

In some configurations, the part of the portable electronic device includes a thin and rigid sheet having an outer edge, with a ledge formed around the outer edge. Receiving the part of the portable electronic device within the slot includes receiving the ledge within the slot.

In some configurations, the slot includes an opening at an outer periphery of the body and an inner channel located inward of the opening. The opening has a first height, wherein the inner channel has a second height that is larger than the first height. A lip is defined between the opening and the inner channel. Receiving the ledge within the slot includes receiving the ledge within the inner channel and abutting the ledge with the lip.

In some configurations, the clamping member is biased toward the disengaged position with a spring.

In some configurations, actuating the lock mechanism includes rotating a lock cylinder with a key and rotating an actuation cam with the lock cylinder.

In some configurations, moving the clamping member from the disengaged position to the engaged position includes linearly translating the clamping member via rotation of the actuation cam.

In some configurations, the security member includes a flexible cable, and coupling the security member to the immovable object includes wrapping the flexible cable around the immovable object.

In yet another embodiment, a clamp lock for securing a portable electronic device includes a C-shaped body defining a slot configured to receive part of the portable electronic device, the slot having an opening at an outer periphery of the body and an inner channel located inward of the opening. The opening has a first height and the inner channel has a second height that is larger than the first height. The clamp lock further includes a clamping member supported by the body. The clamping member is movable relative to the body between a first position, in which the clamping member extends into the slot and is configured to engage the part of the portable electronic device, and a second position, in which the clamping member is configured to disengage the portable electronic device. The clamp lock further includes a security member coupled to the body and configured to be coupled to an immovable object.

In some configurations, the clamp lock further includes a lock mechanism configured to drive the clamping member from the second position to the first position.

In some configurations, the clamp lock further includes a spring configured to bias the clamping member toward the second position.

In some configurations, the clamping member includes a generally planar surface, wherein the generally planar surface is configured to engage the part of the portable electronic device.

In some configurations, the clamping member moves linearly between the first position and the second position.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 5:
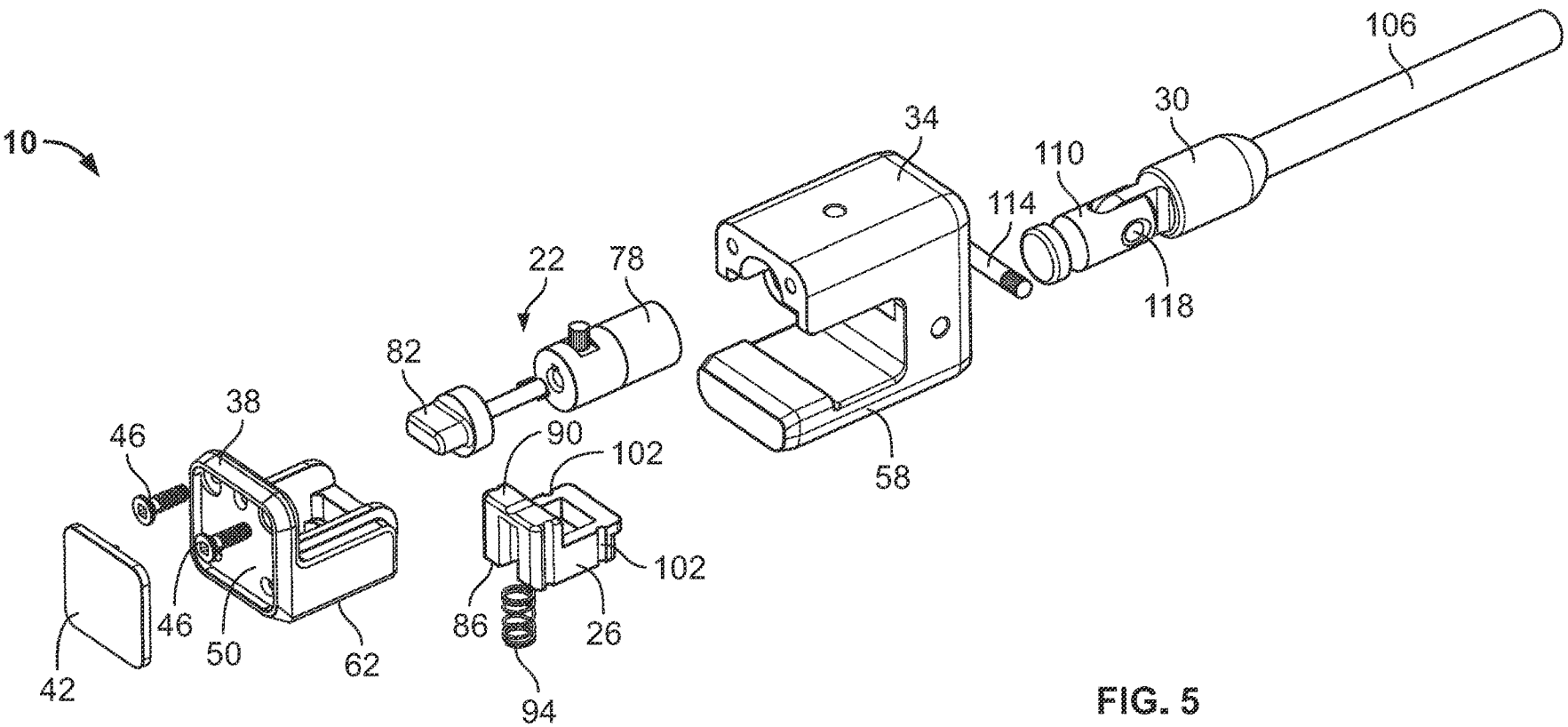
FIG. 5 is an exploded perspective view of the clamp lock.
Figure 6:
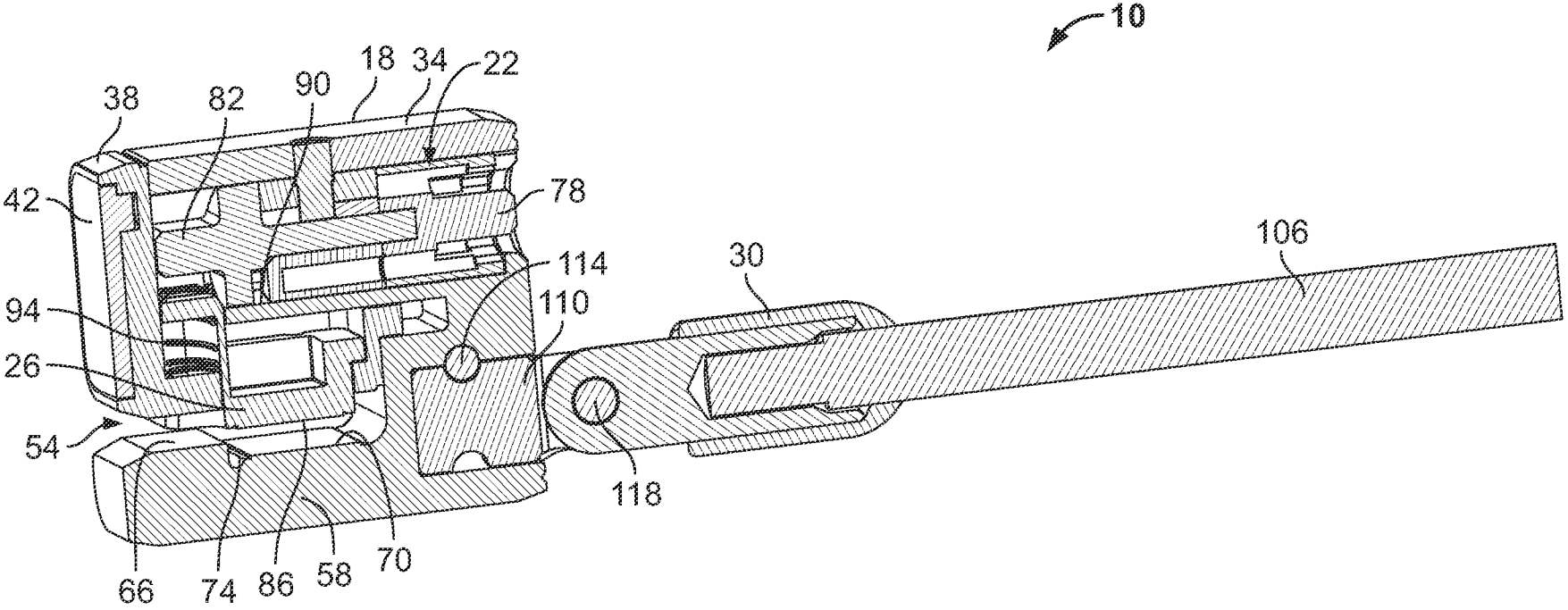
FIG. 6 is a cross-sectional view of the clamp lock.
Figure 7:
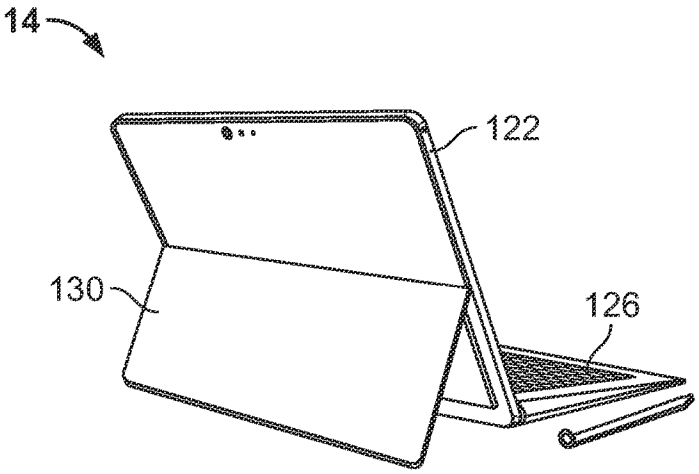
FIG. 7 is a perspective view of a portable electronic device for use with the clamp lock.

FIGS. 1-6 illustrate a clamp lock 10 for use with a portable electronic device 14 (FIG. 7). The clamp lock 10 is configured to engage a relatively thin portion, or sheet, of the portable electronic device 14, such as the kickstand of a Microsoft® Surface Pro computer. In other embodiments, the clamp lock 10 may engage suitable components (e.g., relatively thin portions) of other types of devices. The clamp lock 10 secures the portable electronic device 14 to an immovable object (e.g., a desk, a table, a chair, a bracket, a wall, etc.) to inhibit theft of the portable electronic device 14.

The illustrated clamp lock 10 includes a body 18, a lock mechanism 22 (FIG. 5), a clamping member 26 (FIGS. 3 and 5), and a security member 30. In the illustrated embodiment, the body 18 includes a first or main body portion 34, a second or front body portion 38, and a cover plate 42. The front body portion 38 is coupled to the main body portion 34 by fasteners 46 (e.g., screws). The cover plate 42 extends over a front face 50 of the front body portion 38 to substantially cover the fasteners 46. The cover plate 42 is welded, glued, or otherwise secured to the front body portion 38 to inhibit access to the fasteners 46 and, thereby, disassembly of the body 18. In some embodiments, the cover plate 42 may include a logo or other indicia associated with the clamp lock 10. In some embodiments, the fasteners may be modified to prevent disassembly.

Figure 4:
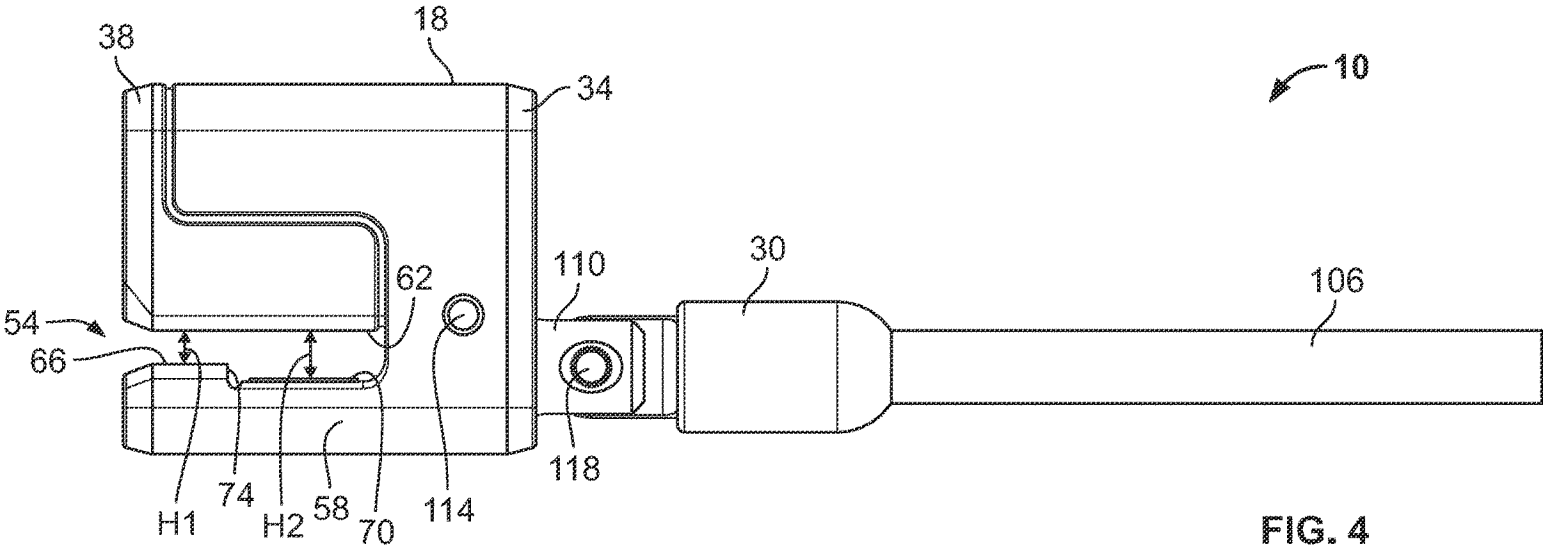
FIG. 4 is a side view of the clamp locking with the clamping member in a disengaged position.

When assembled, the illustrated body 18 is generally C-shaped. The body 18 has a slot 54 formed between a lower leg 58 of the main body portion 34 and a lower surface 62 of the front body portion 38. The slot 54 is configured to receive part of a portable electronic device. In the illustrated embodiment, the slot 54 has an opening 66 at an outer periphery of the body 18 (i.e., near the cover plate 42) and an inner channel 70 located inward of the opening 66. The inner channel 70 is in communication with the opening 66. As shown in FIG. 4, the opening 66 has a first height H1 measured between the lower leg 58 of the main body portion 34 and the lower surface 62 of the front body portion 38. The inner channel 70 has a second height H2 measured between the lower leg 58 of the main body portion 34 and the lower surface 62 of the front body portion 38. The second height H2 is larger than the first height H1 such that a lip 74 is formed in the lower leg 58 at the transition between the opening 66 and the channel 70. The lip 74 helps the clamp lock 10 engage a ledge on a portable electronic device without being pulled off of the portable electronic device, as further explained below.

As shown in FIGS. 5 and 6, the lock mechanism 22 is supported by the body 18. More particularly, the lock mechanism 22 is positioned within the body 18. The illustrated lock mechanism 22 includes a lock cylinder 78 and an actuation cam 82. The lock cylinder 78 is configured to be engaged and rotated by a key. The actuation cam 82 is coupled to the lock cylinder 78 for rotation with the lock cylinder 78. As the actuation cam 82 rotates, the actuation cam 82 engages the clamping member 26 to move the clamping member 26. In other embodiments, the lock mechanism 22 may include, for example, a combination lock and manual actuator to selectively move the actuation cam 82.

The clamping member 26, or locking pad, is supported by the body 18 and operatively coupled to the lock mechanism 22. In the illustrated embodiment, the clamping member 26 is positioned at least partially within the front body portion 38 of the body 18 generally beneath the actuation cam 82 of the lock mechanism 22. The clamping member 26 includes a generally planar lower surface 86 facing the slot 54 and the lower leg 58 of the body 18. The planar surface 86 is described herein as the "lower" surface to facilitate description with reference to the drawings, but it should be understood that the planar surface 86 may be an "upper" or "side" surface depending on the orientation of the clamp lock 10. More accurately, the planar lower surface 86 is the surface of the clamping member 26 that faces the lower leg 58. The planar lower surface 86 is configured to selectively engage part of a portable electronic device that is received within the slot 54 to inhibit removal of the portable electronic device from the slot 54. The clamping member 26 also includes a cam surface 90 facing and aligned with the actuation cam 82 of the lock mechanism 22. As the actuation cam 82 is rotated, the actuation cam 82 pushes against the cam surface 90 to move the clamping member 26. The planar lower surface 86 can have a surface coating or anti-scratch film to prevent the creation of scratches and abrasions to the portable electronic device when assembling and disassembling.

Figure 1:
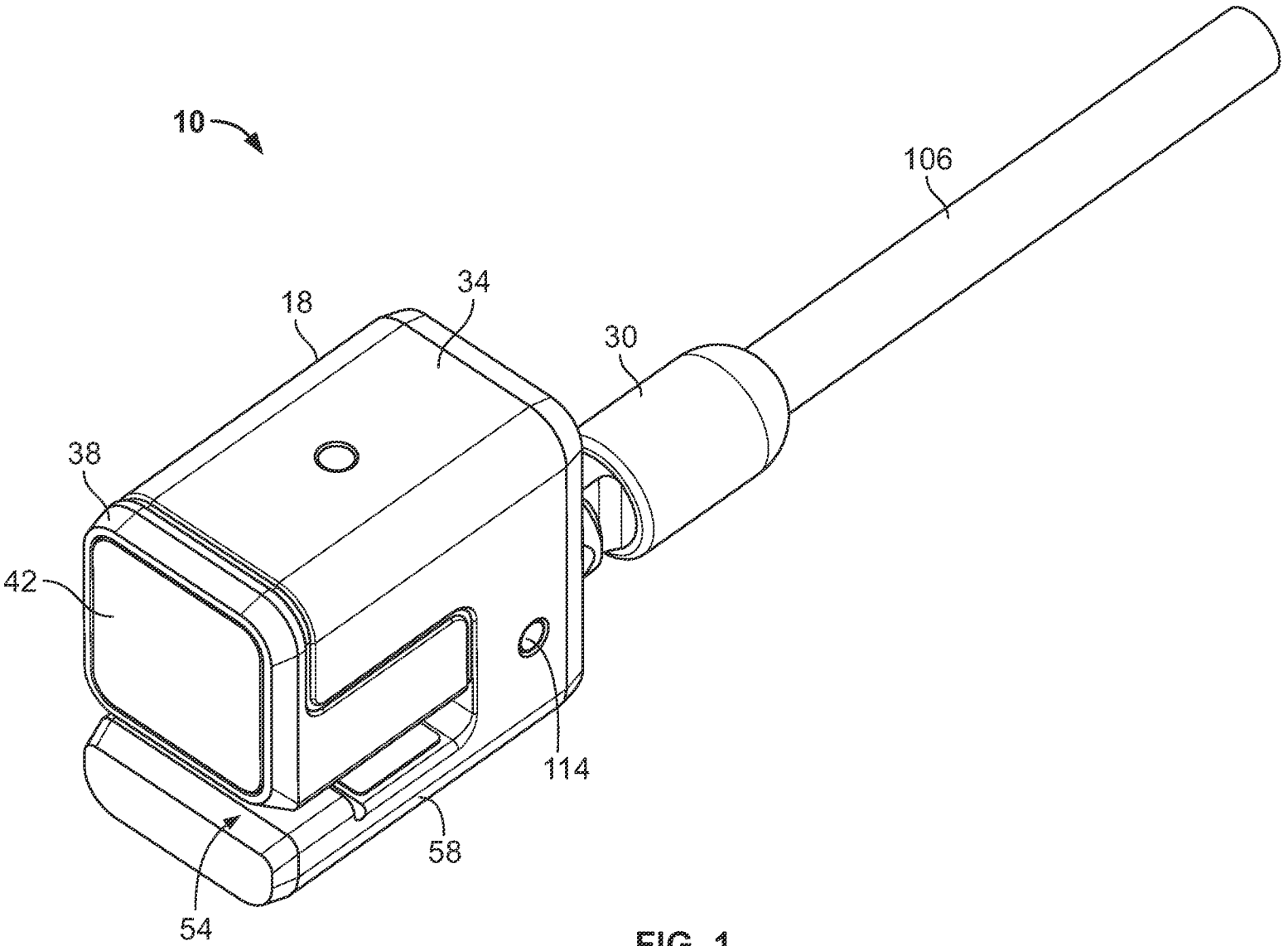
FIG. 1 is a perspective view of a clamp lock embodying the invention.
Figure 2:
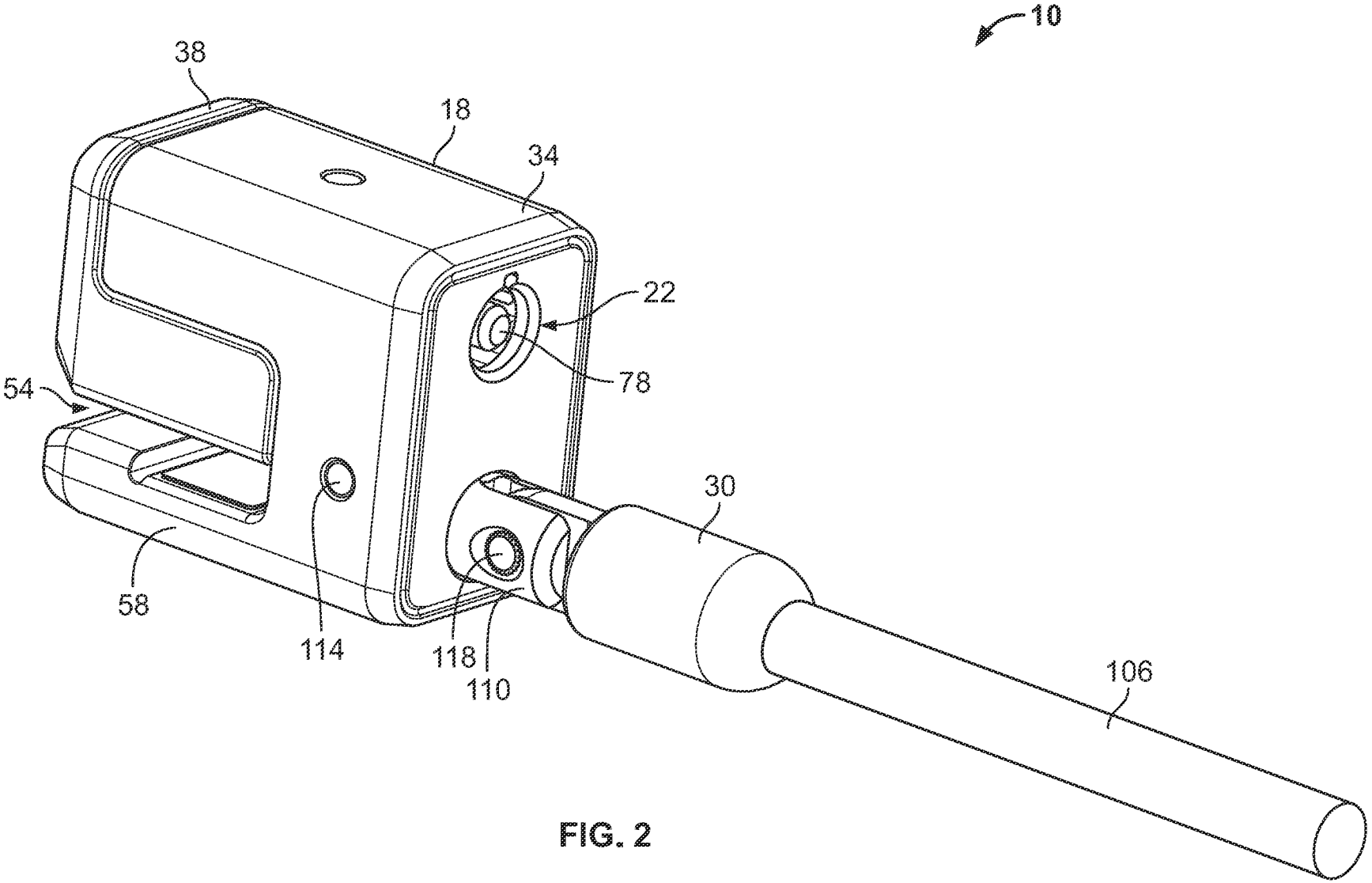
FIG. 2 is another perspective view of the clamp lock.
Figure 3:
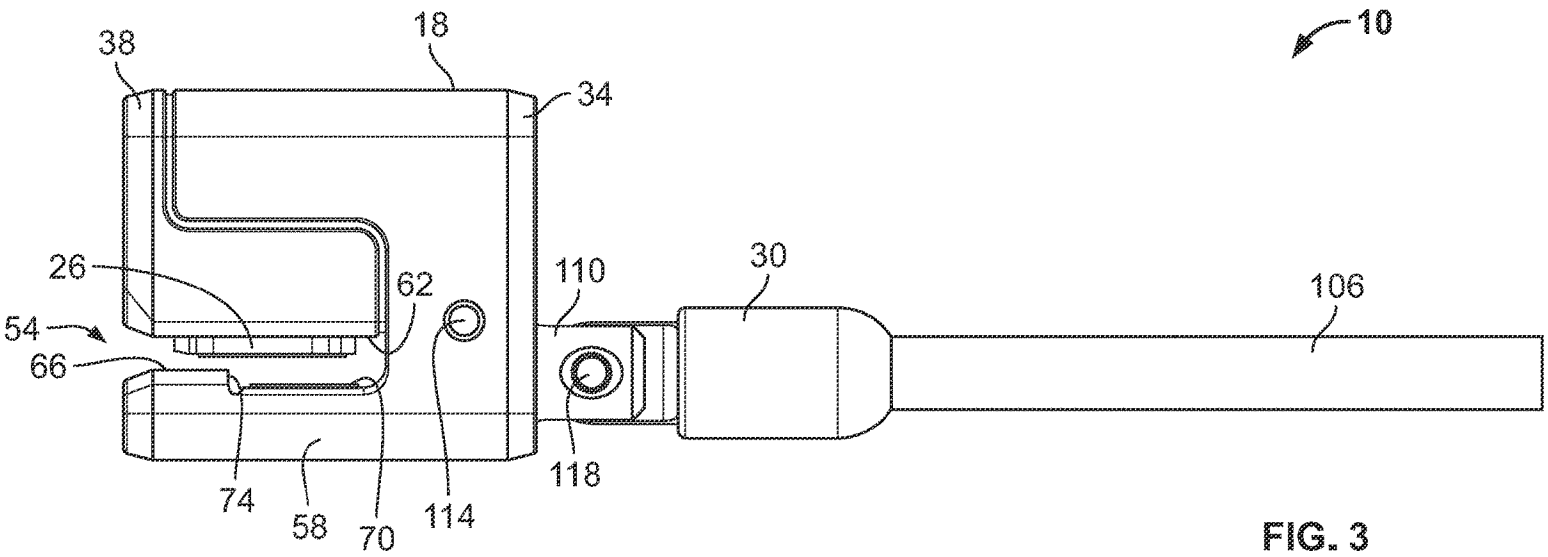
FIG. 3 is a side view of the clamp lock including a clamping member in an engaged position.

The clamping member 26 is movable between a first or engaged position (FIG. 3) and a second or disengaged position (FIG. 4). As shown in FIG. 3, when in the engaged position, at least part of the clamping member 26 extends into the slot 54 of the body 18. In this position, the clamping member 26 is moved toward the lower leg 58 of the body 18 (downward in FIG. 3) and is configured to engage the part of the portable electronic device that is received within the slot 54. As shown in FIG. 4, when in the disengaged position, the clamping member 26 is moved away from the lower leg 58 of the body 18 (upward in FIG. 4). In this position, the clamping member 26 disengages the part of the portable electronic device received within the slot 54 so that the clamp lock 10 can be removed from the portable electronic device. In the illustrated embodiment, the clamping member 26 is completely received within the body 18 when moved to the disengaged position. In other embodiments, the clamping member 26 may still extend partially into the slot 54 when in the disengaged position, but to a lesser degree than when in the engaged position.

In the illustrated embodiment, the clamping member 26 is biased to the disengaged position (upward in FIG. 4) by a spring 94 (e.g., a coil compression spring). The clamping member 26 is moved against the bias of the spring 94 to the engaged position (downward in FIG. 3) by the actuation cam 82. In some embodiments, suitable structures or mechanisms (e.g., a rail and groove) may be used restrict movement of the clamping member 26 to linear motion.

As shown in FIGS. 5 and 6, the security member 30 is coupled to the body 18. The security member 30 is configured to be coupled to an immovable object to inhibit movement of the clamp lock 10 (and, thereby, an attached portable electronic device) away from the immovable object. In the illustrated embodiment, the security member 30 includes a flexible cable 106 that is connected to the body 18 by a ferrule 110. The flexible cable 106 is configured to be wrapped around the immovable object (e.g., wrapped around the leg of a chair or table). The ferrule 110 is secured to the body by an attachment pin 114 extending through part of the body 18. The illustrated ferrule 110 includes a pivot joint 118 to allow some movement of the body 18 relative to the cable 106 without twisting the cable 106. In other embodiments, other suitable security members (e.g., threaded fasteners, adhesives, brackets, etc.) may be used to secure the body 18 of the clamp lock 10 to an immovable object.

FIG. 7 illustrates the portable electronic device 14 for use with the clamp lock 10. In the illustrated embodiment, the portable electronic device 14 is a Microsoft® Surface Pro computer having a main body 122 with a screen and a processor, a keyboard 126, and a kickstand 130. In other embodiments, the clamp lock 10 may be used with other suitable portable electronic devices having a relatively thin sheet or section that is similar to the kickstand 130 of the illustrated device 14.

Figure 9:
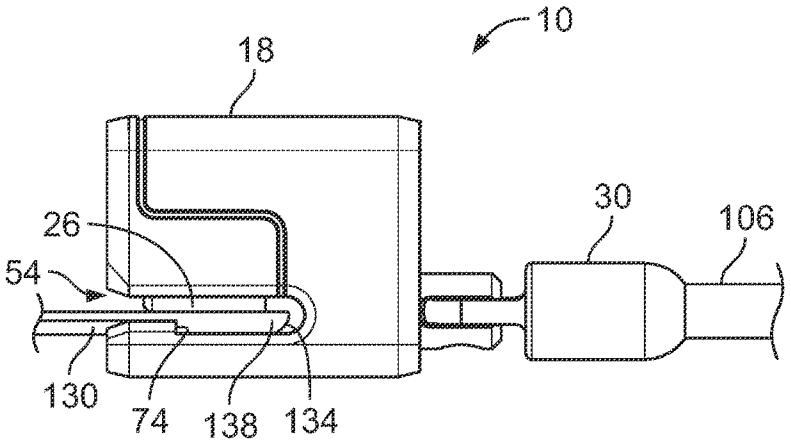
FIG. 9 is a side view of the part of the portable electronic device being engaged by the clamp lock.
Figure 8:
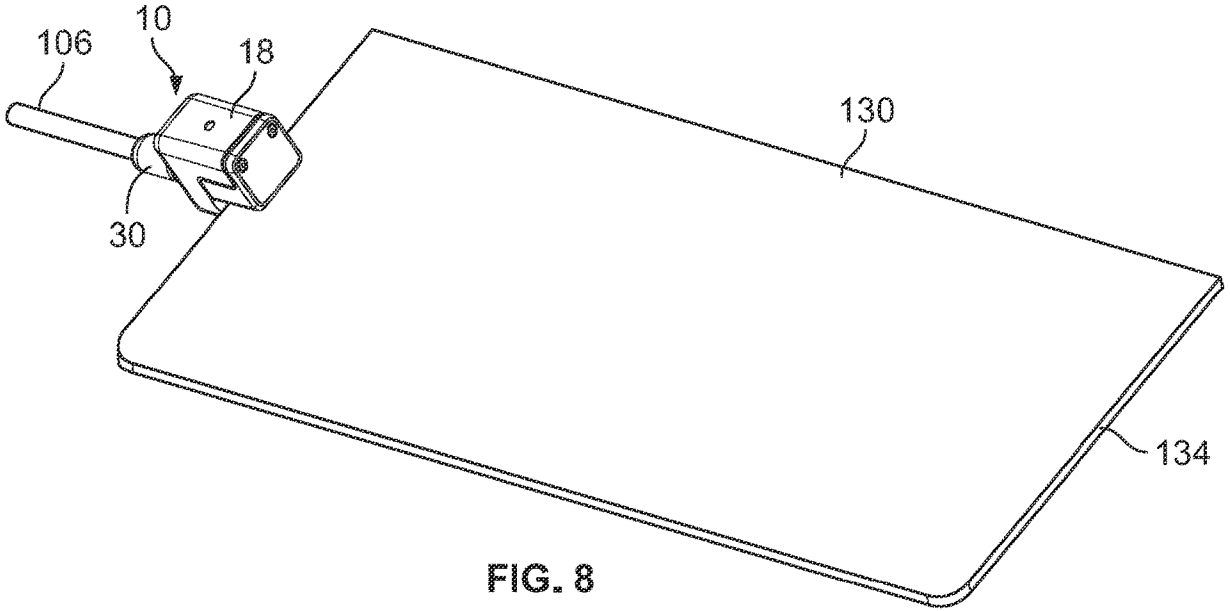
FIG. 8 is a perspective view of part of the portable electronic device being engaged by the clamp lock.

As shown in FIGS. 8 and 9, the illustrated kickstand 130 is a relatively thin and rigid sheet having an outer edge 134. The kickstand 130 also includes a ledge 138 formed around the outer edge 134. The ledge 138 is generally thicker than the remainder of the kickstand 130. When the outer edge 134 of the kickstand 130 is received in the slot 54 of the clamp lock 10, as shown in FIG. 9, the ledge 138 abuts the lip 74 of the clamp lock 10, inhibiting the clamp lock 10 from being pulled off of the kickstand 130. As such, the clamp lock 10 engages the kickstand 130 (or other thin sheet of a portable electronic device) in a relatively secure manner.

FIGS. 10A-14B illustrate further locking adaptors for providing physical security to a portable electronic device having a kickstand and/or no integrated security slot. The locking adaptors interface with separate "laptop locks" to form different types of clamp locks. Specifically, FIG. 10A-10D illustrate a locking adaptor 100 according to one embodiment of the invention. The illustrated locking adaptor 100 includes two legs 104, 108 that are pivotally coupled together, but biased apart. The legs 104, 108 are positioned on opposing sides of a thin sheet 112, and a shroud 116 is slid over the legs 104, 108 to press the legs 104, 108 together. The shroud 116 includes a slot for attachment to a laptop lock 120 (e.g., a Kensington T-bar lock, etc.) having a cable 124 that can be secured to an immovable object. When attached, the laptop lock 120 inhibits the shroud 116 from sliding off of the legs 104, 108 and, thereby, inhibits the legs 104, 108 from disengaging the thin sheet 112.

Figure 10B:
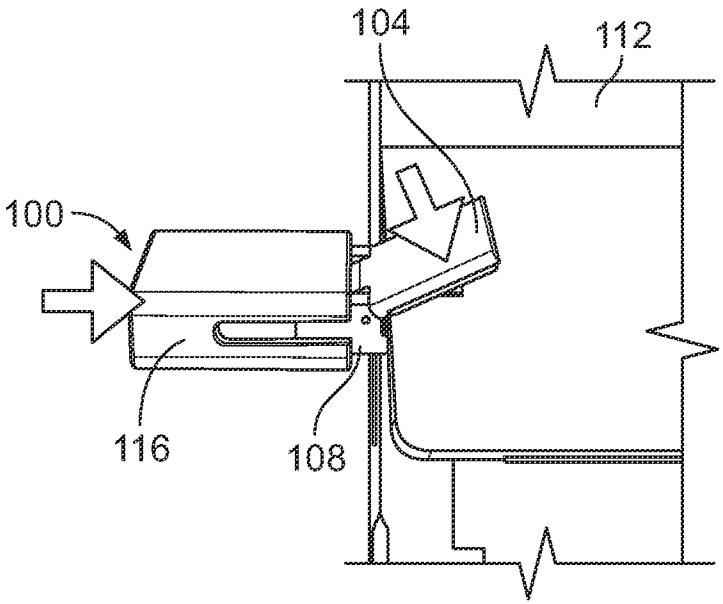
FIG. 10B is a perspective view of the clamp lock of FIG. 10A extending around the part of the portable electronic device.
Figure 10A:
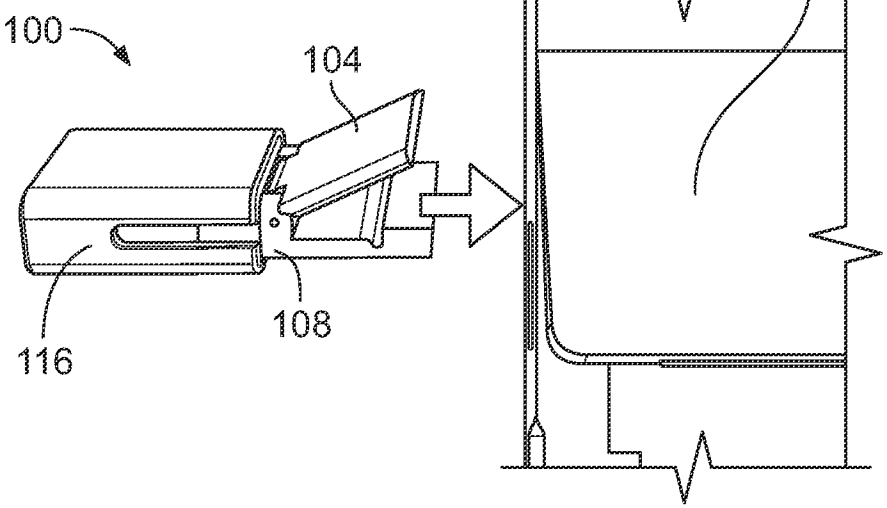
FIG. 10A is a perspective view of a clamp lock according to another embodiment, the clamp lock spaced apart from a part of a portable electronic device.
Figure 10D:
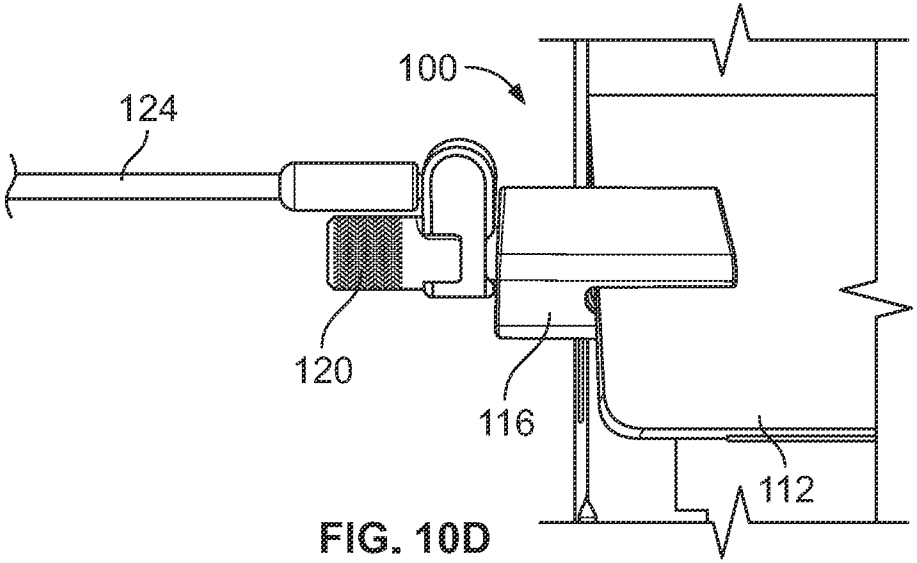
FIG. 10D is a perspective view of the clamp lock of FIG. 10A having a security member.
Figure 10C:
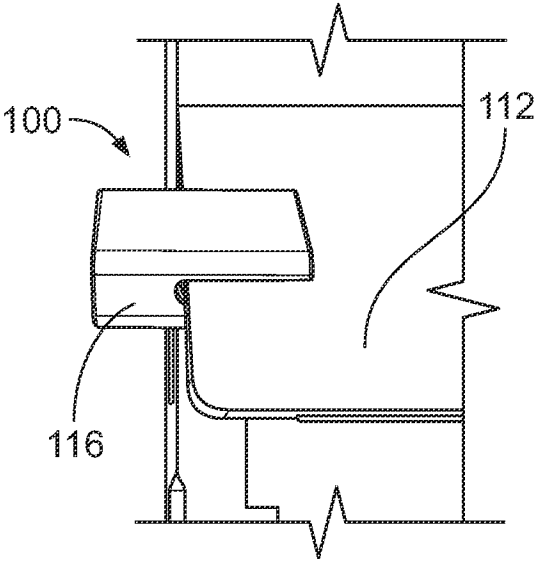
FIG. 10C is a perspective view of the clamp lock of FIG. 10A attached to the part of the portable electronic device.
Figure 10E:
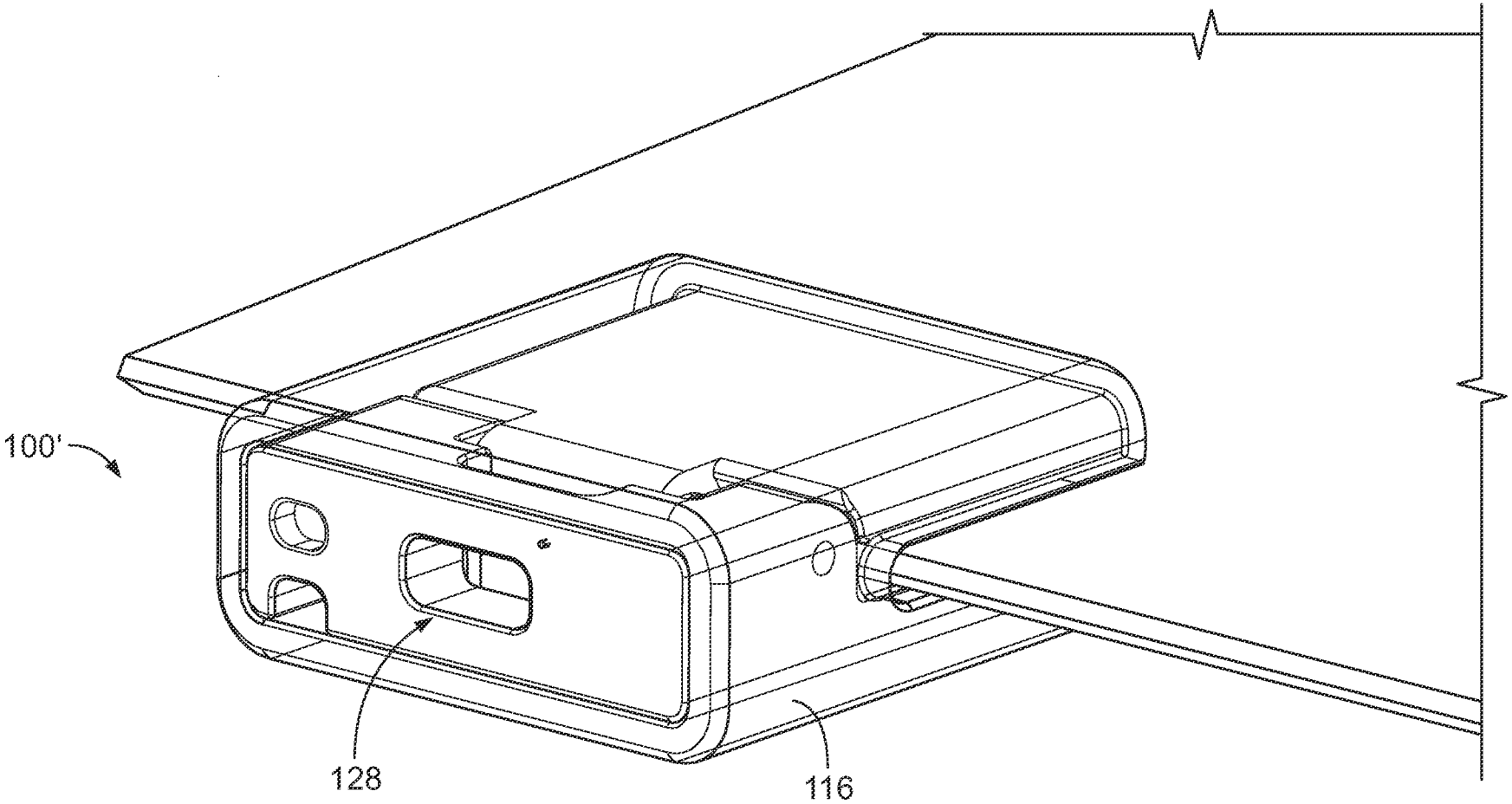
FIG. 10E is a perspective view of a clamp lock according to another embodiment of the invention.

FIG. 10E illustrates an alternative locking adaptor 100' that is similar to the locking adaptor 100. The illustrated locking adaptor 100' includes a slot 128 implemented in one of the legs 108. When the shroud 116 is positioned over the legs 104, 108 and the laptop lock 120 is attached to the slot 128, the laptop lock 120 inhibits the shroud 116 from sliding off of the legs 104, 108 by physically blocking movement of the shroud 116 (i.e., the body of the laptop lock 120 is larger than the clearance required to move the shroud 116).

Figure 11:
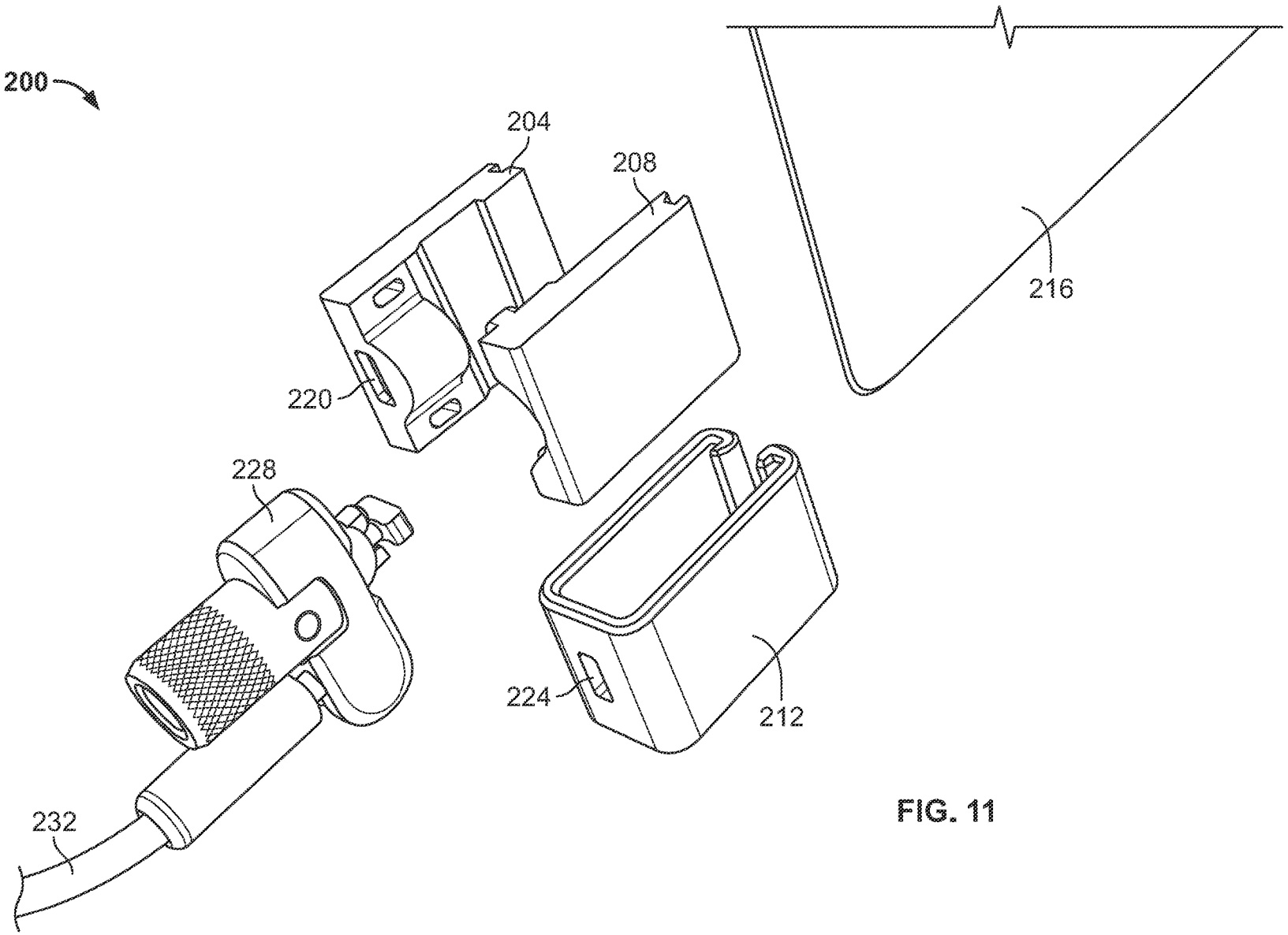
FIG. 11 is an exploded perspective view of a clamp lock according to yet another embodiment of the invention.

FIG. 11 illustrates a locking adaptor 200 according to another embodiment of the invention. The illustrated locking adaptor 200 includes three separate parts 204, 208, 212. Two mating parts 204, 208 are positioned on opposing sides of a thin sheet 216, and the third part 212 is slid over the two mating parts 204, 208. One of the two mating parts 204 and the third part 212 both include slots 220, 224 for attachment to a laptop lock 228 having a cable 232 that can be secured to an immovable object. When attached, the laptop lock inhibits 228 the locking adaptor 220 from being disassembled and removed from the thin sheet 216.

Figure 12A:
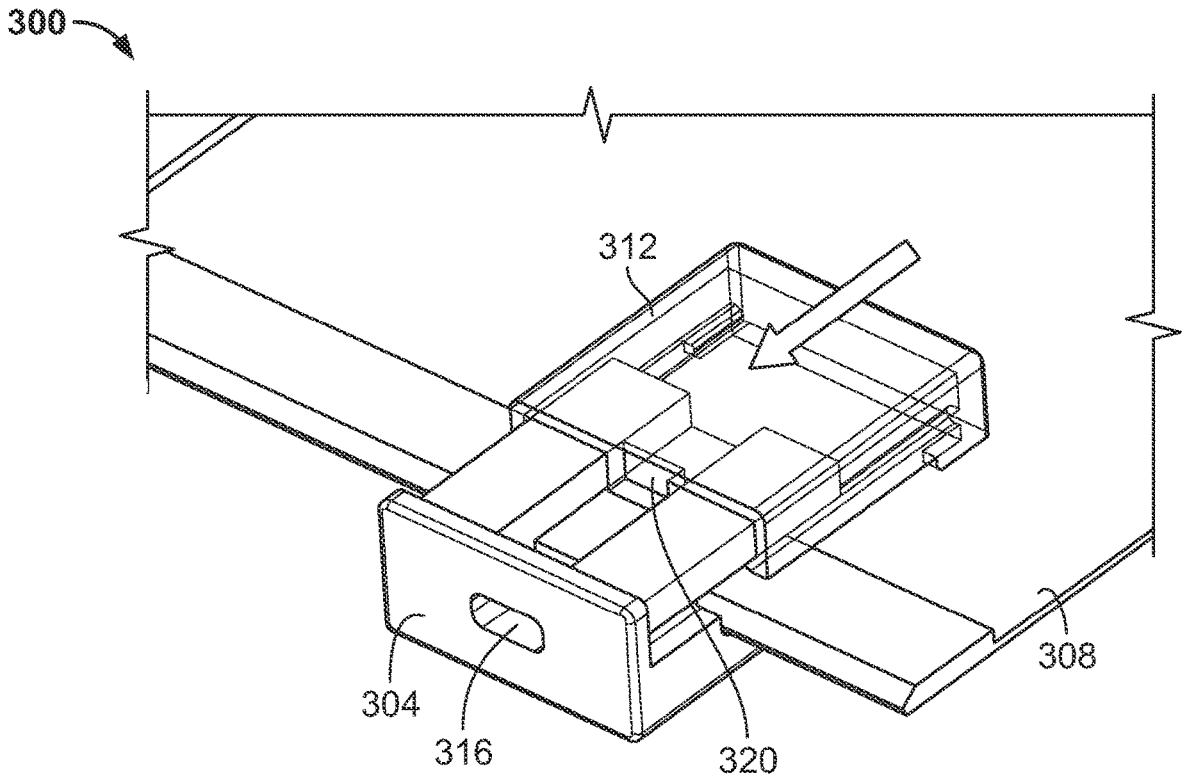
FIG. 12A is a perspective view of a clamp lock according to yet another embodiment of the invention.
Figure 12B:
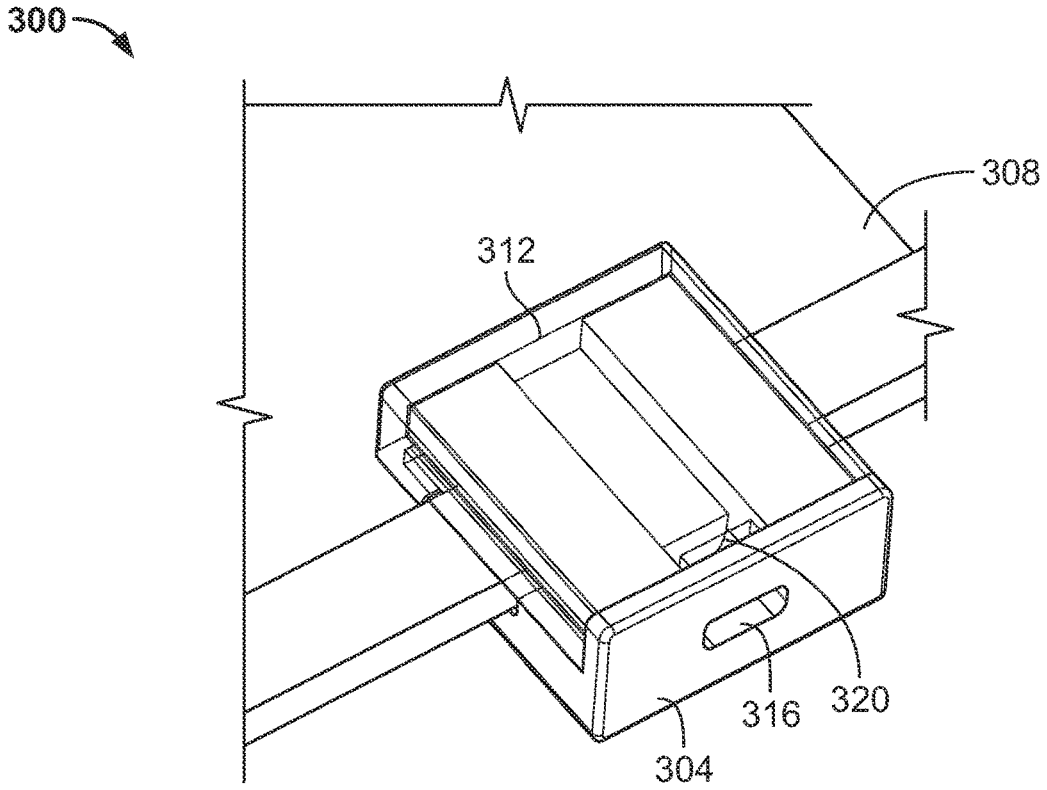
FIG. 12B is a perspective view of the clamp lock of FIG. 12A in an engaged position.

FIGS. 12A-12B illustrate a locking adaptor 300 according to yet another embodiment of the invention. The illustrated locking adaptor 300 includes a first component 304 that is slid onto an edge of a thin sheet 308, and a second component 312 that slides on a track of the first component 304. The two components 304, 312 may be assembled relative to one another prior to or after locating the components 304, 312 relative to the thin sheet 308. The first component 304 and the second component 312 both include slots 316, 320 for attachment to a laptop lock having a cable that can be secured to an immovable object. When the slots 316, 320 are aligned and adjacent, the laptop lock is attached to the slots 316, 320 to inhibit the second component 312 from sliding relative to the first component 304 and disengaging the thin sheet 308.

Figure 13A:
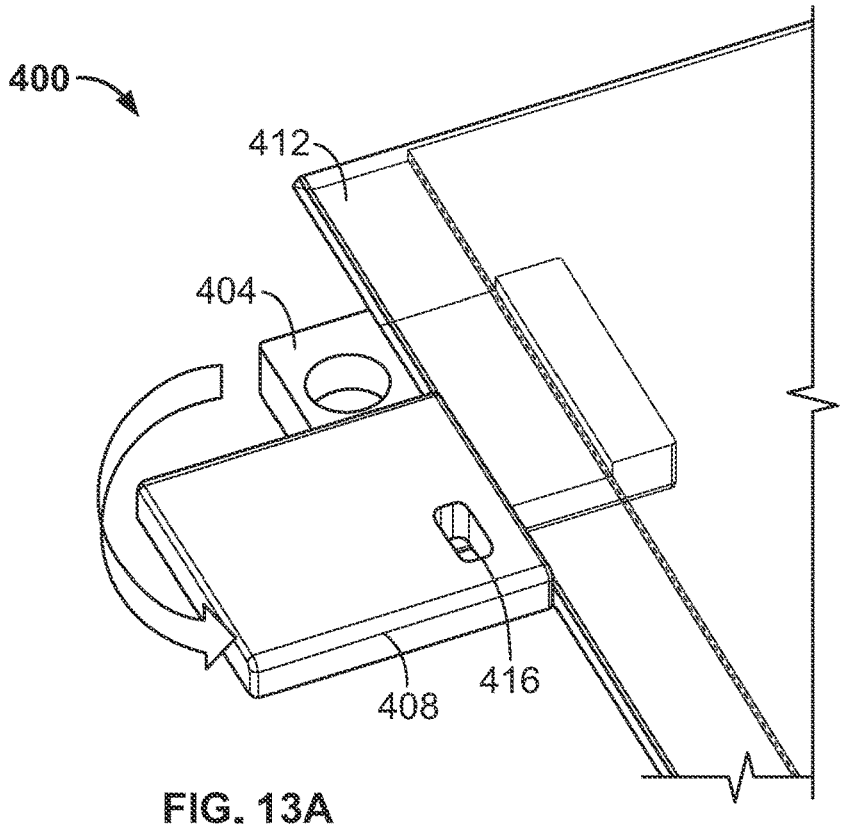
FIG. 13A is a perspective view of a clamp lock according to yet another embodiment of the invention.
Figure 13B:
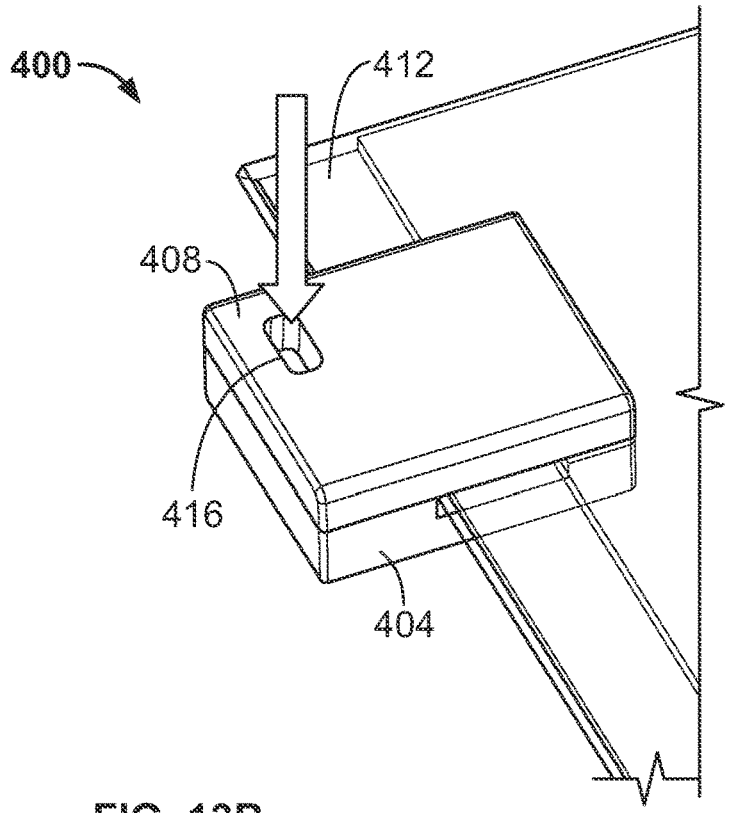
FIG. 13B is a perspective view of the clamp lock of FIG. 13A in an engaged position.

FIGS. 13A-13B illustrate a locking adaptor 400 according to still another embodiment of the invention. The illustrated locking adaptor 400 includes two halves 404, 408 rotatably coupled together. The first half 404 is positioned on one side of a thin sheet 412, and the second half 408 is positioned on another side of the thin sheet 412. The second half 408 is then rotated to a closed position (FIG. 13B), in which the first and second halves 404, 408 are generally aligned to capture part of the thin sheet 412 between the two halves 404, 408. The second half 408 includes a slot 416 for attachment to a laptop lock having a cable that can be secured to an immovable object. When attached, the laptop lock inhibits the second half 408 from rotating open relative to the first half 404 and, thereby, disengaging the thin sheet 412.

Figure 14A:
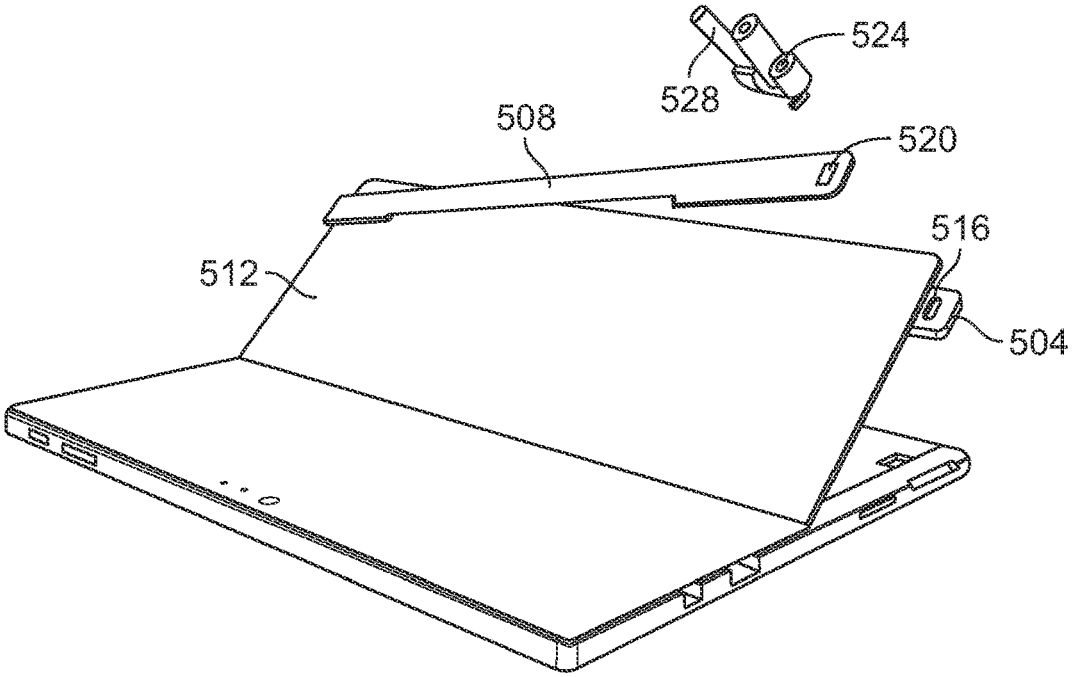
FIG. 14A is a perspective view of a clamp lock and portable electronic device according to yet another embodiment of the invention.
Figure 14B:
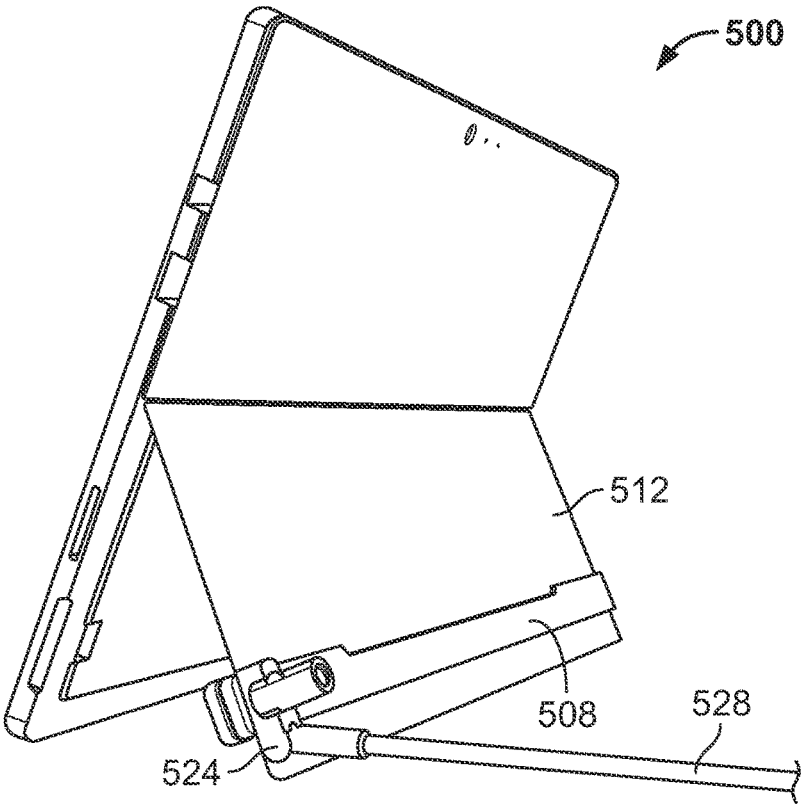
FIG. 14B is a perspective view of the clamp lock and portable electronic device of FIG. 14A in an engaged position.

FIGS. 14A-14B illustrate a locking adaptor 500 according to yet still another embodiment of the invention. The illustrated locking adaptor 500 includes two bars 504, 508 that are positioned on opposing sides of a thin sheet 512. The bars 504, 508 extend an entire dimension (e.g., length or width) of the thin sheet 512. Both bars 504, 508 include slots 516, 520 for attachment to a laptop lock 524 having a cable 528 that can be secured to an immovable object. When the slots 516, 520 are aligned, the laptop lock 524 is attached to the slots 516, 520 to inhibit the bars 504, 508 from separating and disengaging the thin sheet 512.

The locking adaptors provide physical security to Microsoft® Surface Pro products or similar devices with a kickstand or no integrated security slot. A main advantage of the locking adaptors is to easily secure onto the device's kickstand with a sliding, rotating, or clamping component. With one of the locking adaptors affixed around the device's kickstand, a laptop lock is used to secure the locking adaptor, anchoring the locking adaptor onto the device. This arrangement offers users a non-intrusive security solution for thin and mobile devices that include a thin sheet or component, such as a kickstand.

The locking adaptors can be composed of, for example, CNC machined, die cast, or stamped metal parts in order to provide desired strength requirements. Each locking adaptor can also incorporate injection molded components or anti-scratch adhesive-backed films where strength is not as necessary, or for scratch resistance on a contacting surface. To anchor the locking adaptors onto a device's kickstand, a user can rotate, slide, or clamp the parts together. This configuration allows the locking adaptors to stay attached to the device without a lock. With a laptop lock inserted, the locking adaptors and attached device are secured from potential theft.

The locking adaptors provide non-intrusive security solutions for devices with a kickstand (or other thin sheet) and no integrated security slot. Each adaptor can be quickly installed or removed from the device, for an effortless user experience. The adaptors are small and compact, making them useful for on-the-go security while in a more portable user environment. A laptop lock, such as a Kensington® lock, is used with each adaptor as the last step to restrict removal of the adaptor from the kickstand.

Various features and advantages of the invention are set forth in the following claims.

What is claimed is:

1. A clamp lock for securing a portable electronic device, the clamp lock comprising:

a body;

a lock mechanism coupled to the body;

a clamping member supported by the body and operatively coupled to the lock mechanism, the clamping member and the body cooperatively defining a slot, the clamping member being movable relative to the body by actuating the lock mechanism from a first position, in which the clamping member is configured to engage the portable electronic device, to a second position, in which the clamping member is configured to disengage the portable electronic device;

a security member coupled to the body and configured to be coupled to an immovable object; and a spring coupled to the body and configured to bias the clamping member toward the second position, wherein the slot includes an opening at an outer periphery of the body and an inner channel located inward of the opening, wherein the opening has a first height, and wherein the inner channel has a second height that is larger than the first height.

2. The clamp lock of claim 1, wherein a height of the slot between the body and the clamping member is a first distance when the lock mechanism is in the first position and is a second distance when the lock mechanism in the second position, wherein the second distance is greater than the first distance.

3. The clamp lock of claim 1, wherein the lock mechanism includes a lock cylinder configured to be actuated by a key, and an actuation cam coupled to the lock cylinder for rotation with the lock cylinder.

4. The clamp lock of claim 3, wherein the actuation cam is operatively coupled to the clamping member, the clamping member being movable relative to the body by actuating the actuation cam.

5. The clamp lock of claim 1, wherein the clamping member includes a generally planar surface, wherein the generally planar surface is configured to engage the portable electronic device.

6. The clamp lock of claim 1, wherein the clamping member moves linearly between the first position and the second position.

7. The clamp lock of claim 1, wherein the security member includes a ferrule secured to the body, and a flexible cable secured to the ferrule.

8. A clamp lock for securing a portable electronic device, the clamp lock comprising:

a generally C-shaped body having a slot formed between a lower leg of the generally C-shaped body and a surface of a portion of the generally C-shaped body facing the lower leg, the slot configured to receive a part of the portable electronic device;

a lock mechanism positioned within the generally C-shaped body, the lock mechanism configured to adjust the clamp lock from a disengaged position, in which the slot has a first height, to an engaged position, in which the slot has a second height that is less than the first height and the part of the portable electronic device is inhibited from being removed from the slot;

a spring positioned within the generally C-shaped body configured to compress relative to a resting position of the spring when in the engaged position and to bias the clamp lock toward the disengaged position; and a flexible cable coupled to the body and configured to be coupled to an immovable object.

9. The clamp lock of claim 8, wherein the lock mechanism moves a component of the clamp lock linearly between the disengaged position and the engaged position.

10. The clamp lock of claim 8, wherein the surface of the portion of the generally C-shaped body that faces the lower leg is a generally planar surface and is configured to engage the part of the portable electronic device in the engaged position.

11. The clamp lock of claim 8, wherein the slot includes an opening at an outer periphery of the generally C-shaped body and an inner channel located inward of the opening, wherein, in the disengaged position, a height of the slot at the inner channel is greater than a height of the slot at the opening.

12. The clamp lock of claim 11, wherein, in the engaged position, the height of the slot at the inner channel is greater than the height of the slot at the opening.

13. The clamp lock of claim 8, wherein the lock mechanism is positioned within the generally C-shaped body opposite the lower leg such that the slot is located between the lock mechanism and the lower leg.

14. A clamp lock for securing a portable electronic device, the clamp lock comprising:

a body having a first body portion and a second body portion, the first body portion having a first surface, the second body portion having a second surface generally parallel to the first surface, the first surface and the second surface defining a slot therebetween, the slot configured to receive part of the portable electronic device, the slot having an opening at an outer periphery of the body and an inner channel located inward of the opening, the opening having a first height, and the inner channel having a second height that is larger than the first height; and a spring positioned within the body, wherein the first surface is a generally planar first surface, and the second surface is a generally planar, stepped surface wherein the clamp lock is configurable between a first position, in which the clamp lock is configured to engage the part of the portable electronic device within the slot, and a second position, in which the clamp lock is configured to disengage the portable electronic device, and wherein the spring is configured to bias the clamp lock toward the second position.

15. The clamp lock of claim 14, further comprising a security member coupled to the body and configured to be coupled to an immovable object.

16. The clamp lock of claim 14, further comprising a lock mechanism supported by the body and configured to secure the clamp lock in the first position.

17. The clamp lock of claim 16, further comprising an actuation cam coupled to the lock mechanism, wherein the actuation cam is operable to hold the clamp lock in the first position against a bias of the spring.

18. The clamp lock of claim 16, wherein the lock mechanism moves a component of the clamp lock linearly between the first and second positions.

19. The clamp lock of claim 14, wherein the second surface is a generally planar surface, wherein the generally planar surface is configured to engage the part of the portable electronic device.

20. The clamp lock of claim 14, wherein a height of the slot within the inner channel is less in the first position than the height of the slot within the inner channel in the second position.

* * * * *